United States Patent [19]

Moreton

[11] 4,030,707

[45] June 21, 1977

[54] BLENDER

[75] Inventor: George C. Moreton, Winston-Salem, N.C.

[73] Assignee: Electronic Data Controls Corporation, Winston-Salem, N.C.

[22] Filed: Sept. 15, 1975

[21] Appl. No.: 613,269

[52] U.S. Cl. ..... 259/8; 259/44; 259/108; 259/DIG. 25

[51] Int. Cl.[2] ..... B01F 7/26

[58] Field of Search ..... 259/8, 23, 24, 43, 44, 259/66, 67, 107, 108, DIG. 25, 35

[56] References Cited

UNITED STATES PATENTS

| | | | |
|---|---|---|---|
| 1,237,222 | 8/1917 | Shroder | 259/7 |
| 2,858,083 | 10/1958 | Shurts | 259/8 |
| 3,227,425 | 1/1966 | Stanier | 259/43 |
| 3,285,578 | 11/1966 | Edwards et al. | 259/8 |
| 3,863,904 | 2/1975 | Milik | 259/8 |

FOREIGN PATENTS OR APPLICATIONS

| | | | |
|---|---|---|---|
| 20,960 | 12/1899 | United Kingdom | 259/108 |

*Primary Examiner*—Charles E. Phillips
*Assistant Examiner*—Richard R. Stearns
*Attorney, Agent, or Firm*—Richards, Shefte, & Pinckney

[57] ABSTRACT

A blender for mixing components to produce a liquid product has an upstanding cylindrical bowl with a rotating circular disc at the bottom thereof. The disc has a circular periphery closely adjacent the side wall of the bowl and an undersurface closely adjacent the bottom wall of the bowl. Rotation of the disc effects blending of the product components and importantly creates a centrifugal draft at the disc periphery and undersurface sufficient to prevent the liquid product to flow downwardly past the disc during blending rotation thereof while the spacing of the disc from the bowl walls is sufficient to allow the blended product to flow past the disc through a discharge port in the bottom wall of the bowl when the disc rotation is stopped. Preferably, the discharge port remains open during disc rotation to allow the draft to draw upwardly through the port, and the bottom wall of the bowl and the undersurface of the disc are inclined outwardly to enhance the upward action of the draft that prevents downward product flow. In an alternate embodiment, the uppersurface of the disc is also inclined outwardly to direct the product centrifugally upward during disc rotation.

2 Claims, 8 Drawing Figures

BLENDER

BACKGROUND OF THE INVENTION

This invention relates to blenders for mixing liquids, liquids and powders, or similar products. More particularly, it pertains to blenders of the type having a disc or impeller that rotates within a confined bowl to blend components for discharge of a blended product through a discharge port below the disc or impeller.

Prior blenders of this general type either required some positive means for closing the discharge port during blending and opening the discharge port during subsequent discharge, which inherently involved manufacturing and operating costs and maintenance problems, or other prior blenders were designed to permit continuous discharge during blending, which involved problems in obtaining thorough blending while allowing continuous and adequately rapid discharge. An example of a prior blender of the latter type is disclosed in my co-pending U.S. patent application Ser. No. 391,466, filed Aug. 24, 1973, which provides an arrangement of impeller blades and stationary baffles that cooperate to direct the product to a discharge port for discharge of the product therefrom continuously during the blending operation.

In contrast to the prior art, the present invention uniquely utilizes a continuously open discharge port in combination with a simple rotating disc arrangement that inherently prevents discharge flow during blending rotation of the disc. As a result, a simple and inexpensive device is provided that is operable to obtain thorough blending and full subsequent discharge without structural complication.

SUMMARY OF THE INVENTION

Briefly described, the blender of the present invention has a mixing bowl with a generally upstanding cylindrical side wall and a bottom wall. A blending disc is mounted in the bowl for rotation about a generally vertical axis coaxial with the cylindrical side wall of the bowl, and has a generally circular periphery closely adjacent the cylindrical side wall and an undersurface closely adjacent the bottom wall of the bowl. Means for receiving product components to be blended is provided in the bowl above the disc and a discharge port is formed in the bottom wall of the bowl below the disc for discharge of blended product therethrough. Means are also provided for rotating the disc to effect blending of the product components and to create a centrifugal draft at the disc periphery and undersurface, which periphery and undersurface are sufficiently close to the bowl side wall and bottom wall to prevent product flow therepast during the centrifugal draft created by disc rotation while being spaced sufficiently therefrom to permit product flow therepast to the discharge port when the disc is not rotating.

Preferably the discharge port is open to permit the draft to draw upwardly therethrough during disc rotation, and the disc undersurface and bowl bottom wall are inclined outwardly to enhance creation of an upward centrifugal draft to prevent product flow downwardly past the disc during rotation thereof. Also preferably, the spacing between the disc and the side wall and bottom wall of the bowl is approximately one-eighth inch.

Baffles may be provided on the side wall of the bowl above the disc to create blending turbulence, and the uppersurface of the disc may be inclined upwardly and outwardly from a depressed central portion to direct the product centrifugally upward during disc rotation, with ports extending through the disc from the depressed central portion downwardly to the undersurface thereof to allow passage of product therethrough to the discharge port when the disc is not rotating.

DESCRIPTION OF THE PREFERRED EMBODIMENTS

Figure 2:
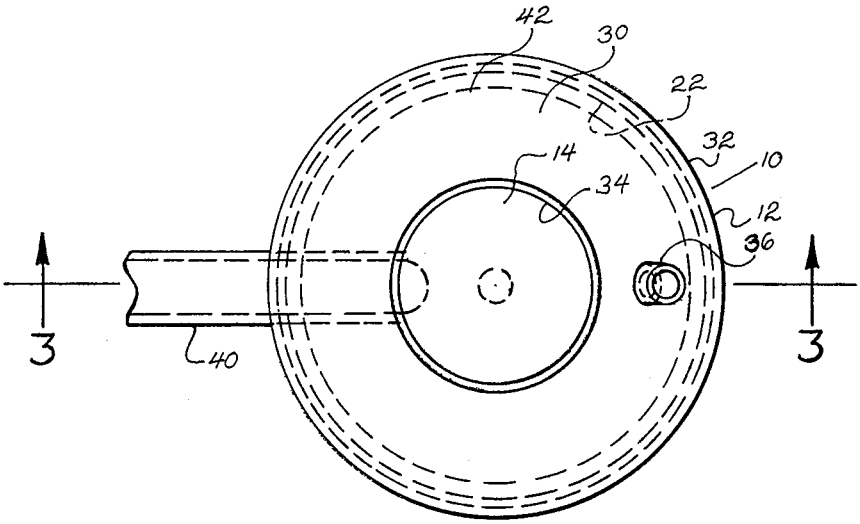
FIG. 2 is a top plan view of the blender of FIG. 1.
Figure 1:
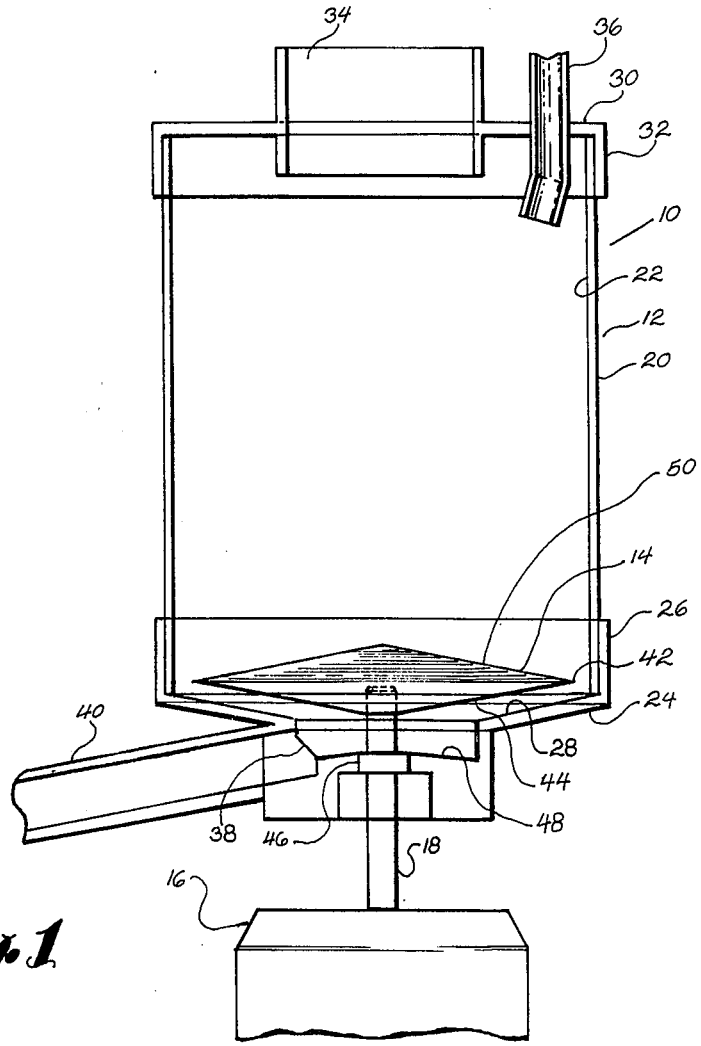
FIG. 1 is an elevational view of a blender of the preferred embodiment of the present invention.

Referring to the embodiment of the present invention illustrated in FIGS. 1–4, the blender 10 is seen to comprise a bowl 12 of clear plastic material that may be mounted in an outer housing or on a frame (not shown), and a rotating blending disc mounted for rotation in the bottom of the bowl 12 and driven by an electric motor 16 mounted on the housing or frame below the bowl 12 and connected to the disc 14 by a drive shaft 18.

The bowl 12 includes a generally upstanding cylindrical body 20 that defines a cylindrical side wall 22 of the bowl 12. The cylindrical body 20 is seated in a bottom cup 24 and sealed to the side 26 thereof. This bottom cup 24 defines a bottom wall 28 in the bowl 12. The top of the bowl body 20 is covered by a top cap 30 having a side 32 surrounding the top of the bowl body 20. The bowl 12 is further formed with means for receiving product components above the disc 14, which means comprises a large central opening 34 in the top cap 30 through which a flavor concentrate component in powder or liquid form is introduced into the bowl 12, and a smaller, offset, opening 36 in the top cap 30 through which the base liquid component of the product to be blended is introduced to the bowl 12 and directed generally toward the center of the disc 14 for blending with the aforementioned flavor concentrate component. The bowl 12 is further formed with a discharge port 38 in the bottom wall 28 and connected to a delivery conduit 40 extending from the bottom cup 24 to a discharge location (not shown).

The blending disc 14 is mounted in the bowl 12 for rotation about a generally vertical axis coaxial with the cylindrical side wall 22 of the bowl 12. The disc 14 has a generally circular periphery 42 closely adjacent the cylindrical side wall 22, and an undersurface 44 closely adjacent the bottom wall 28 of the bowl. The electric motor 16 acting through the drive shaft 18, which is supported in an annular seal bearing 46 in the center of the bottom cup 24, provides means for rotating the disc to create a centrifugal draft at the disc periphery 42 and undersurface 44. The disc 14 is shaped and located to position its periphery 42 and undersurface 44 sufficiently close to the bowl side wall 22 and bottom wall 28 to prevent product flow therepast during the centrifugal draft created by the rotating disc 14 while spaced sufficiently to permit product flow therepast to the discharge port 38 when the disc 14 is not rotating. In the preferred embodiment the spacing between the disc periphery 42 and the bowl side wall 22 is approximately one-eighth inch and the spacing between the disc undersurface 44 and the bowl bottom wall 28 is also one-eighth inch. The inner diameter of the bowl 12 may be of any selected dimension, such as 3 inches, and the rate of rotation of the disc 14 may be selected as desired, for example 1,000 revolutions per minute.

Preferably, the discharge port 38 and delivery conduit 40 remain open during disc rotation to facilitate the aforementioned draft to draw upwardly therethrough. To further enhance the draft function by providing a centrifugally upward action, the disc undersurface 44 and the bowl bottom wall 28 are inclined outwardly in an inverted frusto-conical configuration, in the bottom wall 28 from a generally centrally located lower portion or bottom cavity 48 to the bowl side wall 22, and in the disc undersurface 44 from the drive shaft 18 to the disc periphery 42. Also for this purpose and to facilitate discharge of the entire contents of the bowl 12, the discharge port 38 is disposed in the central bottom cavity 48 of the bottom wall 28. The uppersurface 50 of the disc 14 is shown in FIGS. 1–4 to be of a wide conical configuration to facilitate discharge disc, the contents of the bowl without residue on the disc. but this configuration may be varied as desired, as shown for example in the embodiment of FIGS. 5–8.

Figure 3:
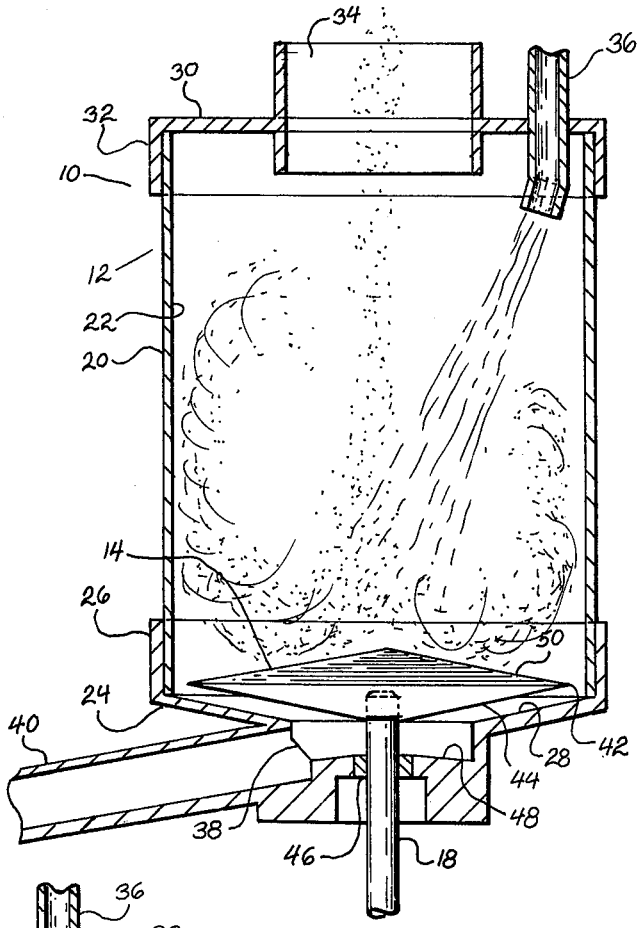
FIG. 3 is a vertical sectional view of the blender of FIGS. 1 and 2 as viewed along line 3—3 of FIG. 2 and showing the blender in operation blending product components therein.
Figure 4:
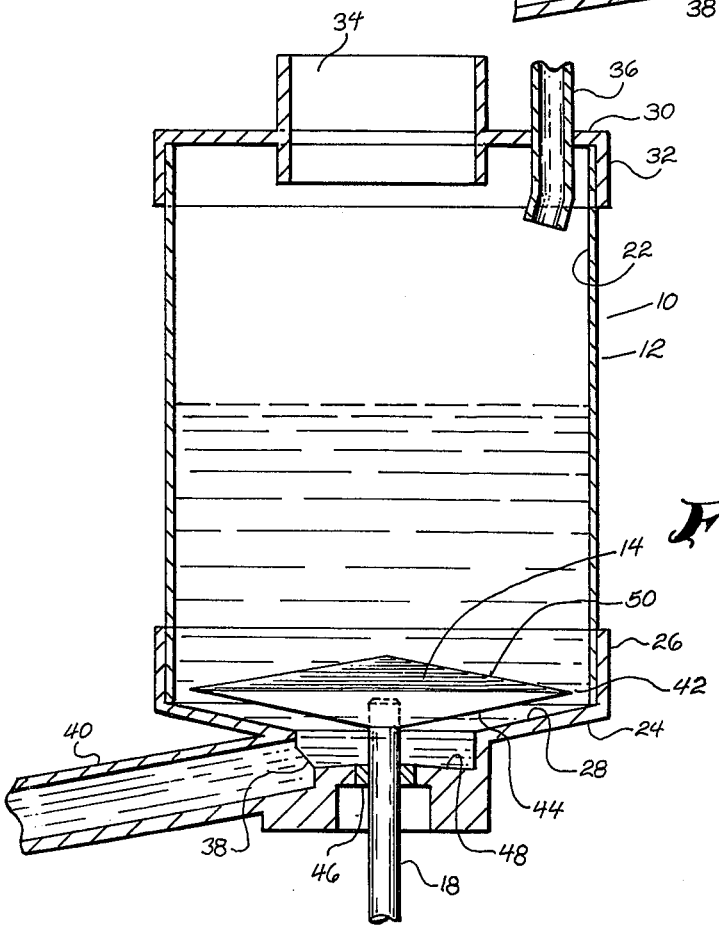
FIG. 4 is a view similar to FIG. 3 showing the blender as the blended product is being discharged therefrom.
Figure 6:
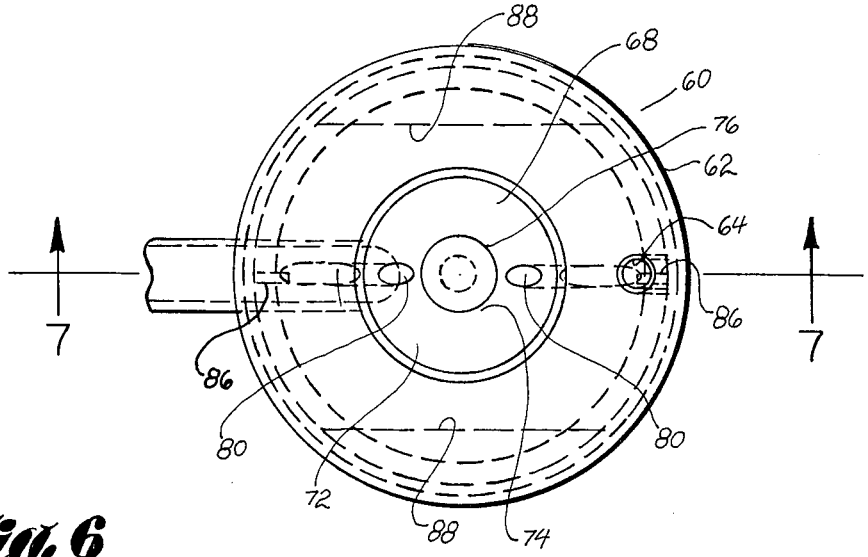
FIG. 6 is a top plan view of the blender of FIG. 5.
Figure 5:
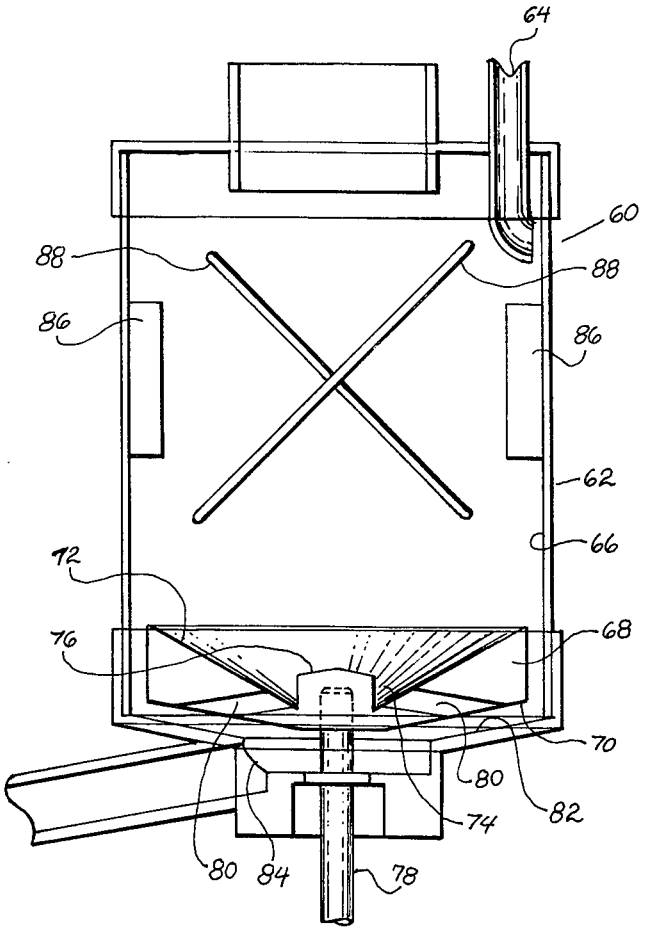
FIG. 5 is an elevational view of a blender of an alternate embodiment of the present invention.
Figure 7:
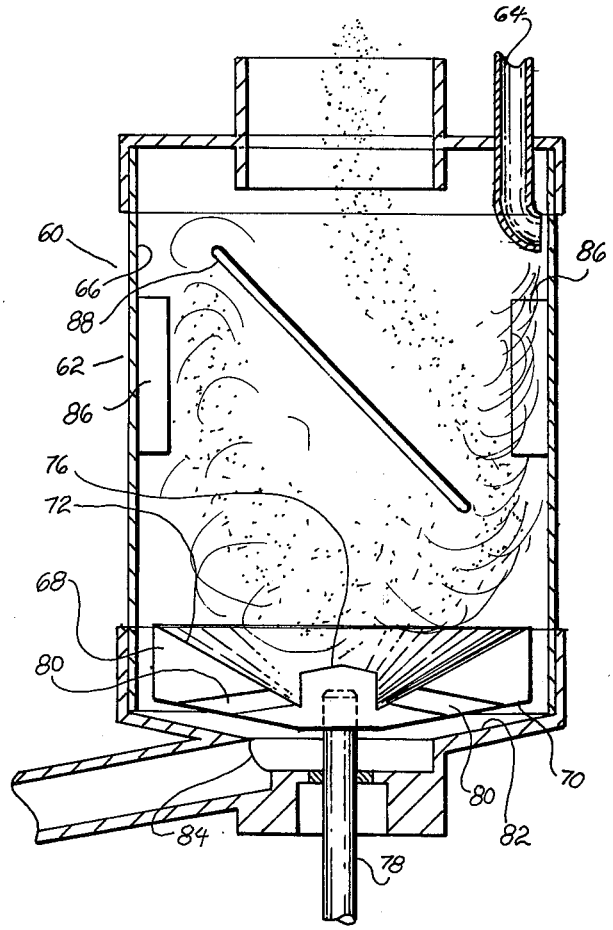
FIG. 7 is a vertical sectional view of the blender of FIGS. 5 and 6 as viewed along line 7—7 of FIG. 6 and showing the blender in operation blending product components therein.
Figure 8:
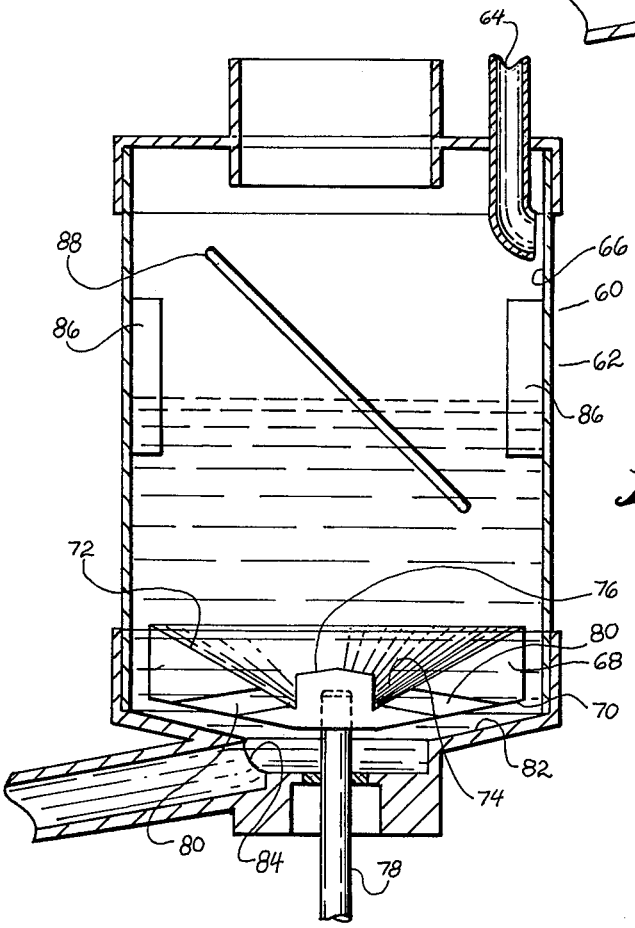
FIG. 8 is a view similar to FIG. 7 showing the blender as the blended product is being discharged therefrom.

In operation of the blender illustrated in FIGS. 1–4, a cycle of operation begins by energizing the electric motor 16 to rotate the disc 14 and while the disc is rotating the base liquid, such as water, is received into the bowl 12 through the small opening 36 and a flavor concentrate in liquid or powder form is received through the large opening 34, as shown in FIG. 3. Sufficient product components are introduced to provide a blended product of a quantity sufficient to substantially fill a cup (not shown) into which the blended product is to be discharged from the delivery conduit 40.

The aforedescribed dimensional and locational relationships of the disc 14 to the bowl 12 in combination with the rotation of the disc 14 create the aforementioned draft that is sufficient to form a barrier to prevent flow of the product components past the disc during rotation thereof and to create an upward draft into the bowl 12 from the open discharge port 38, which causes circularly upward swirling and turbulence in the product components sufficient to effect rapid and thorough blending.

After a relatively short period of disc rotation, for example 10 seconds in the illustrated embodiment, the electric motor 16 is de-energized, terminating rotation of the disc, at which time the blended product settles and is released by termination of the aforementioned draft to pass downwardly past the disc 14 to the bottom cavity 48 in the bowl bottom wall 28 and from there through the discharge port 38 that opens into the bottom cavity 48 and finally through the delivery conduit 40, with the conical shape of the disc uppersurface 50 and the inverted frusto-conical configuration of the bottom wall 28 facilitating thorough discharge of all of the blended product from the bowl 12.

The blender of the present invention is particularly adaptable to blending pre-sweetened ice tea, instant tea and coffee, freeze-dried coffee and other similar products where concentrates are mixed with water or other base liquids. With these particular examples vigorous agitation of the components in prior blenders has resulted in a tendency of the product to become highly aerated and therefore unacceptable as a beverage, whereas with the blender of the embodiment of FIGS. 1–4 of the present invention the disc configuration and draft effect cause an upwardly circular swirling that does not create significant undesirable aeration.

The aforementioned approximately ⅛ inch spacing between the disc periphery 42 and the bowl side wall 22 and between the disc undersurface 44 and bowl bottom wall 28 has been found to provide optimum results in preventing flow during disc rotation and permitting sufficient flow for rapid discharge when the disc is not rotating. Excessive variation from this dimension will, if less, restrict the rate of product discharge, or, if more, may allow slow leakage of the product components during the blending operation. However, the spacing between the disc and the bowl walls of approximately one-eighth inch includes closer spacings limited by the capacity of flow therepast when the disc is not operating and larger spacings limited by the draft creating capability. Also, the spacing at the side wall may be varied over a wide range when the spacing at the bottom wall is at an optimum and vice versa, and the spacings may be varied to best suit the composition and consistency of the product. Satisfactory results with different products have been obtained with spacings as close as one-sixteenth inch and as large as one-fourth inch. Similarly, the rate of rotation of the disc may be varied for best results depending on the type, consistency and desired aeration, and the rate of rotation would influence also the optimum disc spacings for the particular product being blended.

For blending ingredients that are preferably highly agitated or whipped and aerated, such as fruit flavored milk shakes, hot chocolate or cocoa products and similar beverages, from dry granulated concentrates or liquid concentrates, the variation of the preferred embodiment of the present invention as illustrated in FIGS. 5–8 may be used, in which a variation of the disc design is used in combination with baffles formed in the bowl side wall and with a higher rotation speed for the disc. In this alternate embodiment the blender 60 has a bowl 62 similar to the bowl 12 of the embodiment of FIGS. 1–4, except that the offset opening 64 for receiving the base liquid opens adjacent the bowl side wall 66 and faces the side wall to discharge the liquid along the side of the bowl wherein it flows down to the disc 68.

The disc 68 of the embodiment of FIGS. 5–8 has an undersurface 70 similar to that of the disc 14 of the embodiment of FIGS. 1–4 and has peripheral and undersurface spacings similar to that of the embodiment of FIGS. 1–4. However, to enhance upward draft and thereby create greater swirling and turbulence for desired aeration of the product components, the uppersurface 72 of the disc 68 is inclined upwardly and outwardly from a depressed central portion 74 in an inverted frusto-conical configuration that directs the product components centrifugally upward during disc rotation. An upwardly projecting central hub 76 is formed in the depressed central portion 74 to accommodate mounting of the disc 68 on the drive shaft 78. The configuration of the disc uppersurface 72 would tend to retain a portion of the product on the disc after completion of a blending and discharge cycle, but this is prevented by a pair of circumferentially spaced ports 80 formed in the disc 68 and extending therethrough from the depressed central portion 74 adjacent the hub 76 to the undersurface 70. Thus, any blended product that is on the disc undersurface 70 after a blending cycle will drain through the ports 80 for discharge onto the bowl bottom wall 82 and through the discharge port 84.

Further agitation of the product components during the blending cycle is affected by stationary baffles 86, 88 fixed to and projecting inwardly from the bowl side wall 66 above the disc 68. In the illustrated embodiment of FIGS. 5–8 there are two diametrically opposed vertically extending baffles 86 and two diametrically opposed inclined baffles 88. All of the baffles interfere with the circumferentially upward circular swirling action of the product components during the blending cycle, thereby creating further blending turbulence in the product. The combination of some vertical and some inclined baffles further disrupts the flow pattern and adds to the turbulence effect that enhances blending and aeration of the product components.

The operation of the alternate embodiment of FIGS. 5–8 is identical to the operation described hereinabove for the embodiment of FIGS. 1–4 and need not be repeated. Also the parts of the embodiment of FIGS. 5–8 not identified specifically are identical to the corresponding components of the embodiment of FIGS. 1–4 and require no further description.

From the foregoing it is apparent that the present invention provides a blender of simple and inexpensive construction that should require little maintenance and that functions to maintain the product components in suspension above the blending disc during the blending operation without discharge during this stage of the operation and does so without requiring any valve or valve operating mechanism. Rather, the discharge port is allowed to remain open and this serves a positive purpose in allowing air to be drawn therethrough into the bottom of the blender by the draw from the drafting action, thereby supplying air to assist in the creation and maintenance of the draft that causes suspension of the product components above the disc.

It should be understood that the specific configurations illustrated herein may be varied to obtain particular desired results and that the present invention is not intended to be limited by the accompanying drawings or detailed description, which are provided for illustative purposes only. The scope of the present invention is intended to be limited by the appended claims and equivalents thereof.

I claim:

1. A blender for blending liquids, liquids and powders, or similar products comprising a bowl having a generally upstanding cylindrical side wall and a bottom wall, a blending disc mounted in said bowl for rotation about a generally vertical axis coaxial with the cylindrical side wall of said bowl, said disc having a generally circular periphery closely adjacent, said cylindrical side wall and an undersurface closely adjacent the bottom wall of said bowl, said bowl having means for receiving product components above said disc and a discharge port in said bottom wall below said disc for discharge of blended product therethrough, and means for rotating said disc to effect blending of said product components and to create a centrifugal draft at the disc periphery and undersurface, said disc periphery and undersurface being sufficiently close to said bowl side wall and bottom wall to prevent product flow therepast during said centrifugal draft created by the rotating disc while being spaced sufficiently therefrom to permit product flow therepast to said discharge port when said disc is not rotating, the uppersurface of said disc being inclined upwardly and outwardly from a depressed central portion to direct the product centrifugally upward during rotation of said disc, said disc having a port extending therethrough from said depressed central portion downwardly to the undersurface thereof.

2. A blender for blending liquids, liquids and powders, or similar products comprising a bowl having a generally upstanding cylindrical side wall and a bottom wall, a blending disc mounted in said bowl for rotation about a generally vertical axis coaxial with the cylindrical side wall of said bowl, said disc having a generally circular periphery closely adjacent said cylindrical side wall and an undersurface closely adjacent the bottom wall of said bowl, said bowl having means for receiving product components above said disc and a discharge port in said bottom wall below said disc for discharge of blended product therethrough, means for rotating said disc to effect blending of said product components and to create a centrifugal draft at the disc periphery and undersurface, said disc periphery and undersurface being sufficiently close to said bowl side and bottom wall to prevent product flow therepast during said centrifugal draft created by the rotating disc while being spaced sufficiently therefrom to permit product flow therepast to said discharge port when said disc is not rotating, the uppersurface of said disc being inclined upwardly and outwardly from a depressed central portion to direct the product centrifugally upward during rotation of said disc, and a drive shaft extending vertically from said disc rotating means through said bowl bottom wall to said disc, said disc having an upwardly projecting central hub in said depressed central portion to accommodate mounting of said disc on said shaft, and said disc having a pair of circumferentially spaced ports extending therethrough from said depressed central portion adjacent said hub to the undersurface of said disc.

* * * * *

UNITED STATES PATENT OFFICE

CERTIFICATE OF CORRECTION

Patent No. 4,030,707 Dated June 21, 1977

Inventor(s) George C. Moreton

It is certified that error appears in the above-identified patent and that said Letters Patent are hereby corrected as shown below:

Column 3, line 33, delete "disc," and insert therefor -- of --;
Column 3, line 34, delete "." , and insert therefor -- , --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*